US005127721A

United States Patent [19]

Inden

[11] Patent Number: 5,127,721

[45] Date of Patent: Jul. 7, 1992

[54] RETRACTABLE STORAGE SYSTEM FOR CONFINED SPACES

[76] Inventor: Michael Inden, 2241 Semeria Ave., Belmont, Calif. 94002

[21] Appl. No.: 665,013

[22] Filed: Mar. 5, 1991

[51] Int. Cl.[5] ..... A47B 47/02

[52] U.S. Cl. ..... 312/249.9; 312/242

[58] Field of Search ..... 312/242, 322, 330.1, 312/341.1, 245, 246; 211/94

[56] References Cited

U.S. PATENT DOCUMENTS 2,327,761 8/1943 Brodbeck ..... 312/330.1

4,995,682 2/1991 Gutner ..... 312/341.1

*Primary Examiner*—Joseph Falk

[57] ABSTRACT

A retractable storage system for a confined space between two stationary objects comprises a frame (22) made of a metal wire integrally with storage space (46) in the form of baskets. The frame (22) is slidingly installed and guided in two guides (24 and 26). Each guide consists of a stationary member (28) which is rigidly attached to one of the stationary objects, and a moveable member (32) telescopically sliding in the corresponding stationary member. The baskets (46) are shorter than the depth of the confined spaces. From the outer side the frame is closed by a cover (58) which is adjustably attached to the frame (22). The vertical stands (48) of the wire-made frame have upper ends (56) projecting through holes (42) of the upper moveable member (32*a*), while their lower ends (52) are bent perpendicularly to the plane of the frame (22) to engage the frame in the lower moveable member (28*b*). The retractable storage system is convenient for utilizing a space formed between the walls of the kitchen cabinets (16) and outer side walls of a kitchen appliance, such as a microwave oven (14) installed above a cooking range (18) and having a width smaller than the above-mentioned space.

20 Claims, 3 Drawing Sheets

RETRACTABLE STORAGE SYSTEM FOR CONFINED SPACES

BACKGROUND

1. Field of the Invention

The present invention relates to the field of storage systems, particularly a retractable storage system for a confined space.

2. Description of Prior Art

In recent years various new kitchen appliances such as a microwave oven have become convenient and commonly used kitchen features. The dimensions of these new appliances do not always exactly match the existing available spaces in an older kitchen. This often leaves narrow unused openings after a new appliance is installed.

In a common design of a kitchen built during the last several decades a cooking range typically has above itself an exhaust fan with a hood incorporated between kitchen cabinets. Approximately 70% of the hoods are 30 inches wide. To save space in the kitchen, different manufacturers like General Electric, Litton, Quasar and others came up with a design which combines a microwave oven and an exhaust fan. This type of a microwave oven, which is often called an over-the-range microwave oven, replaces the exhaust fan-hood combination in the designated space over the cooking range. Because the majority of kitchen cabinet designs have the above mentioned space equal to 30 inches, manufacturers accepted a standard of 30 inches for the width of the over-the-range microwave ovens.

Most of the remaining kitchen designs have the width of the space for the exhaust fan-hood equal to 36 inches and sometimes to 42 inches. When the over-the-range microwave oven replaces a 36 inches wide exhaust fan-hood, there are two 3 inches wide open spaces one on each side of the microwave oven between the oven and the cabinets and, if the exhaust fan-hood was 42 inches wide, the above mentioned open spaces are each 6 inches wide. The open spaces differ in height as well, depending on a style of the kitchen cabinets. These open spaces ruin the aesthetic appearance of a kitchen.

To solve this problem a carpenter is sometimes asked to close the openings with wood panels to match the interior of the kitchen. In this case the enclosed space is lost completely for any practical use.

General Electric and Bolister Products, Inc. of Los Alamitos, CA offer a filler kit to fill the above mentioned spaces. This kit can be either used to only block and close the opening between the over-the-range microwave oven and kitchen cabinets or to make a very narrow shelf in the opening. Because the shelf is very narrow and fixed, it is not practical to use and hard to clean. It is a reason that, in most instances, the filler kit is only used to close the opening.

Another disadvantage of the above mentioned filler kits is a problem with matching colors. General Electric offers the filler kits only in black. But the over-the-range microwave ovens are manufactured in black, white, almond and several shades of brown. It is obvious that usage of GE black filler kits is restricted by color choice. Bolister Products, Inc. offers a better variety of colors but the color has to be specified for the whole filler kit. It makes manufacturing and inventory control costlier.

Another disadvantage of the filler kits is the problem of closing openings of different heights. General Electric offers filler kits of only one height. Any deviation from this height creates a problem when using GE filler kits. Bolister Products, Inc. offers a better selection of filler kits with 3 different specified heights but still does not answer the needs of all possible variations. This again makes manufacturing and inventory control significantly more expensive.

Objects and Advantages of the Invention

In view of the above, it is an object of the present invention to provide a retractable storage system with several shelves for a very narrow confined space, which easily move in and out of the above mentioned confined space so that the contents of the shelves can be retrieved easily, easy to clean, attractive in appearance, can be economically manufactured, simple to install, easy to adjust to any variation in height of the above mentioned confined space, has a large selection of colors to match economically and easily to existing colors. Other objects and features of the invention will be better understood after consideration of the following description and claims.

BRIEF DESCRIPTION OF DRAWINGS

FIGS. 1–4—DESCRIPTION OF THE CONSTRUCTION OF RETRACTABLE STORAGE SYSTEM FOR CONFINED SPACES

An embodiment of a retractable storage system for confined spaces will be shown and described with reference to FIGS. 1–4.

Figure 1A:
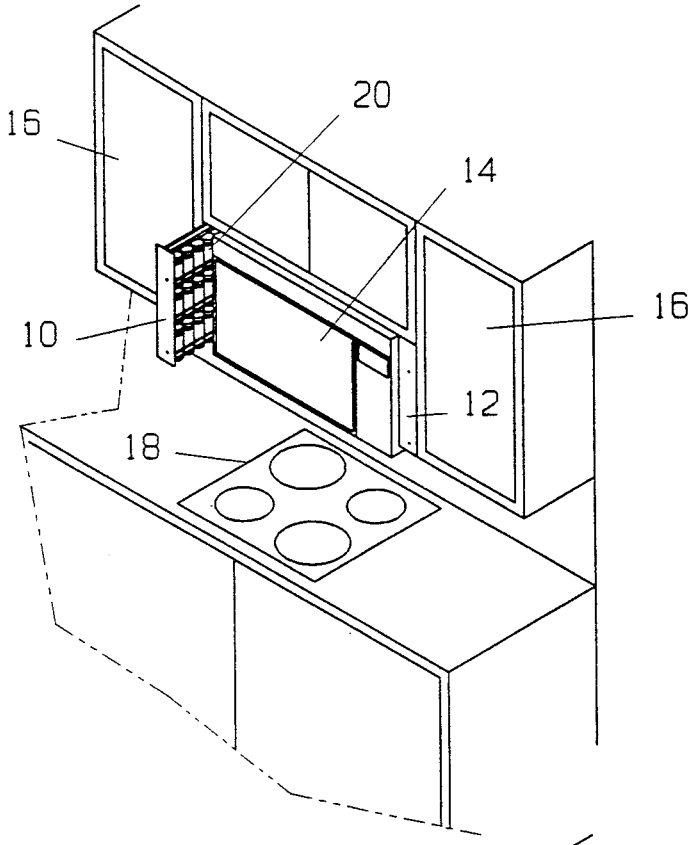
FIG. 1A is a general perspective view of the installed two unit storage system of the invention and an over-the-range microwave oven replacing an existed exhaust fan-hood combination with a unit on one side of the above mentioned microwave oven moved out and filled with typical spice containers.
Figure 1B:
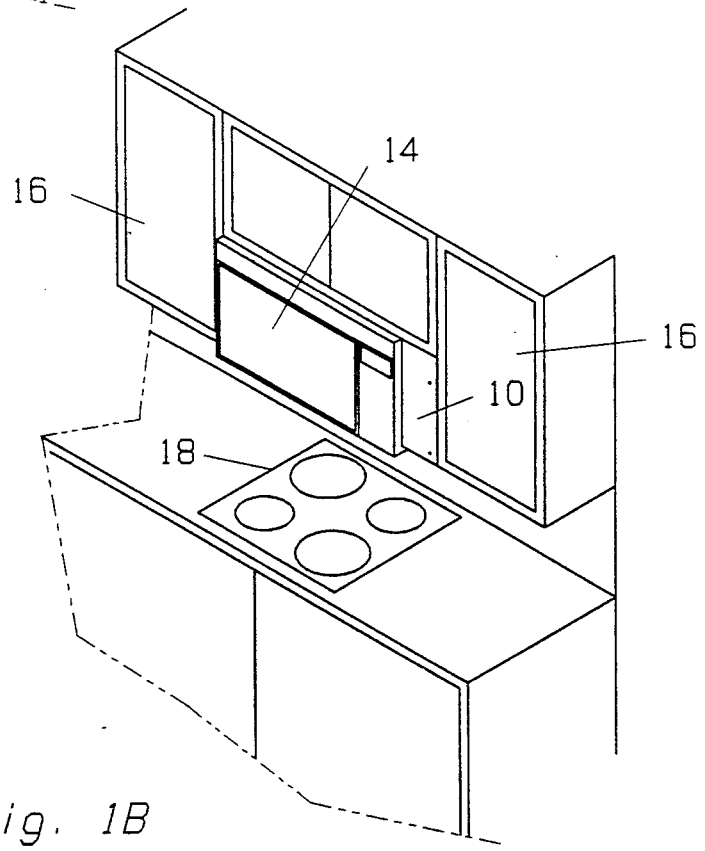
FIG. 1B is a general perspective view of an over-the-range microwave oven with only one installed storage unit of the invention replacing an existed exhaust fan-hood combination.

The device of the invention comprises two storage units which are mirror images of each other and generally designated by reference numerals 10 and 12. FIG. 1A is a perspective view of a part of a typical kitchen illustrating relationships of storage units 10 and 2, an over-the-range microwave oven 14, kitchen cabinets 16, and a cooking range 18. Storage units 10 and 12 of the invention are symmetrically positioned on both sides of microwave oven 14 in a space between kitchen cabinets 16 above cooking range 18. According to accepted practice height of this open space between the kitchen cabinets can vary anywhere between 12 and 16 inches depending on a style of the cabinets. The above mentioned space was originally occupied by an exhaust fan with a hood (not shown in FIG. 1A). Storage unit 12 on the right side of the microwave oven is shown in a moved-in position and storage unit 10 on the left side is shown in a moved-out position with typical containers for spices 20. These containers are located in three rows of baskets.

Storage unit 12 is a mirror image of storage unit 10. It is the reason that only storage unit 10 will now be described with reference to the accompanying drawings FIG. 2 to 4.

Figure 2:
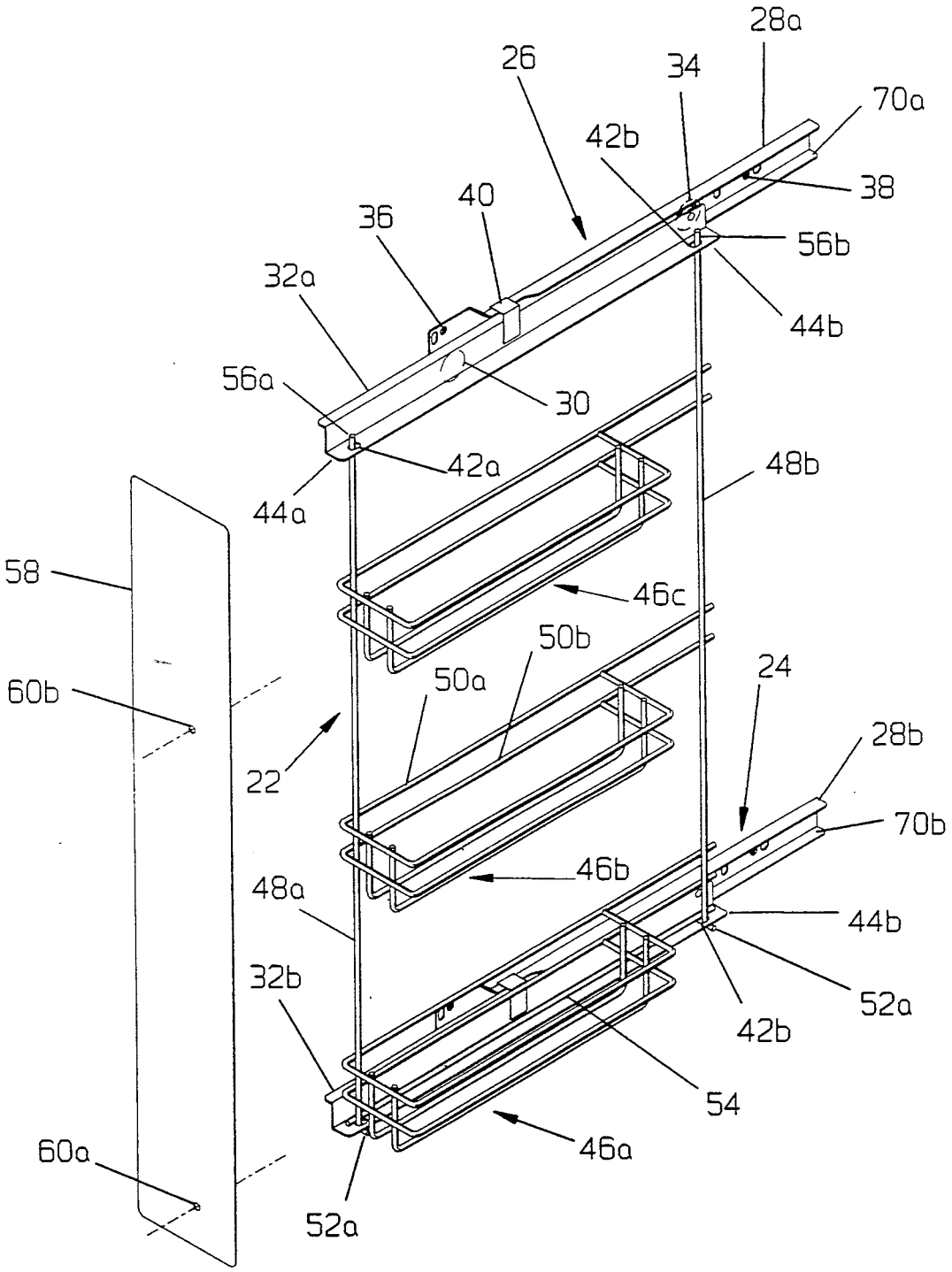
FIG. 2 is a perspective view of the 3-basket retractable storage unit.

As shown in FIG. 2, which is a perspective view of storage unit 10, the device consists of a three-basket assembly 22 engaged onto a side mount slide 24 and hold in place by an identical side mount slide 26. Side mount slides 24 and 26 are readily available from different manufacturers such as for example Julius Blum Inc., of Stanley, N.C. or AMEROCK Corp. of Rockford, Ill. Slide 26 consists of a stationary part 28*a* with a roller 30 at the front end of the stationary part and a moveable part 32*a* with a roller 34 at the back end of the moveable part of the slide. When assembled moveable part 32*a* extends telescopically out of stationary part 28*a* in the same manner like draws of a desk and in the extreme extended position the end of moveable part 32*a* is still staying engaged with stationary part 28*a*. Stationary part 28*a* is attached to the side of kitchen cabinets 16 with wood screws 36 and 38. A U-shaped yoke 40 which serves as a retainer is positioned over stationary part 28*a* and moveable part 32*a* of side mounted slide 26 to prevent them from accidental disengagement but with enough clearance to allow movement of moveable part 32*a*. Retainer 40 can be made from a narrow strip of sheet metal and is hold in place closer to the front when wood screws 36 and 38 are tightened.

Basket assembly 22 is made from welded wire of a diameter to match closely the diameter of elongated slots 42*a* and 42*b* on ends 44*a* and 44*b* of moveable part 32*a* of side mounted slide 26. This wire can be easily cut by a regular wire cutter.

The whole assembly is designed to fit into a limited narrow space so it is important to increase the width of the inner space of baskets 46*a*, 46*b* and 46*c* to a largest possible dimension. If vertical stands 48*a*, 48*b* of basket assembly 22 are welded to the outside of baskets 46*a*–46*c* stands 48*a* and 48*b* will occupy a part of the available space. It is a reason that vertical stands 48*a*, 48*b* of basket assembly 22 are welded to basket wires 50*a*, 50*b* on the side to the inside of baskets 46*a*–46*c*. However vertical stand 48*a* which is inside of the basket will not interfere with a container for spices for example because this stand is positioned very close to the front of the basket and most containers are round.

Baskets 46*a*, 46*b* and 46*c* are made shorter than depth of kitchen cabinets 16 so that in the extreme extended position the whole length of baskets 46*a*–46*c* is exposed and small individual contents can be reached easily because otherwise it is very hard to fetch anything out of the narrow space available for storage unit 10.

In assembly 22 baskets 46*a*–46*c* are spaced apart vertically in such a manner that the items for which baskets are designed can be fetched out without any trouble.

Lower ends 52*a*, 52*b* of vertical stands 48*a*, 48*b* are bent out perpendicularly to the stand and fit into elongated slots 42*a*, 42*b* of moveable part 32*b* of side mount slide 24. A straight wire piece 54 connects both vertical stands 48*a*, 48*b* slightly above bends 52*a*, 52*b* in the same manner as basket wires 50*a*, 50*b*. In the engaged position wire piece 54 prevents assembly 22 from falling down whereas bent ends 52*a*, 52*b* of vertical stands 48*a*, 48*b* keep assembly 22 from moving up.

Free upper ends 56*a*, 56*b* of vertical stands 48*a*, 48*b* fit into identical elongated slots 42*a*, 42*b* of moveable part 28*a* of side mount slide 26 as shown in FIG. 2. Vertical height of stands 48*a*, 48*b* for use as a spice rack with a microwave oven should be 16 inches when built. This way during installation vertical stands can be trimmed with a wire cutter to any desirable height if needed.

A front panel 58 of storage unit 10 shown in FIG. 2 can be made out of different flat material for example a flat metal plate. It has two holes 60*a*, 60*b* to be used by bolts for attachment to basket assembly 22. A bolt 62 goes through hole 60*a* of front panel 58, and as shown in FIG. 5 between wires 50*a*, 50*b* and 64*a*, 64*b* of a basket, through a hole in the center of a backup flat bar 66 and is tightened with a nut 68.

There is enough room for bolt 62 to move between wires 50*a*, 50*b* and 64*a*, 64*b* so that during installation front panel 58 can be adjusted sidewise and/or up and down for the best fit in the space between microwave oven 14 and kitchen cabinet 16.

Front metal panel 58 and heads of bolts 62 are the only parts whose colors have to satisfy color requirements of matching appliance or kitchen cabinets' doors. The other parts of storage units 10 and 12 are exposed only for short time when the storage units are open and their colors are not critical at all for the aesthetic appearance of a kitchen.

A wood panel to match doors of the kitchen cabinets can be used instead of a flat metal panel. In that case to attach the front panel to basket assembly 22 metal screws should be used instead of bolts 62 going from the inside of a basket through flat bar 66 into the wood front panel.

FIG. 2—ASSEMBLY, INSTALLATION AND OPERATION

Figure 3:
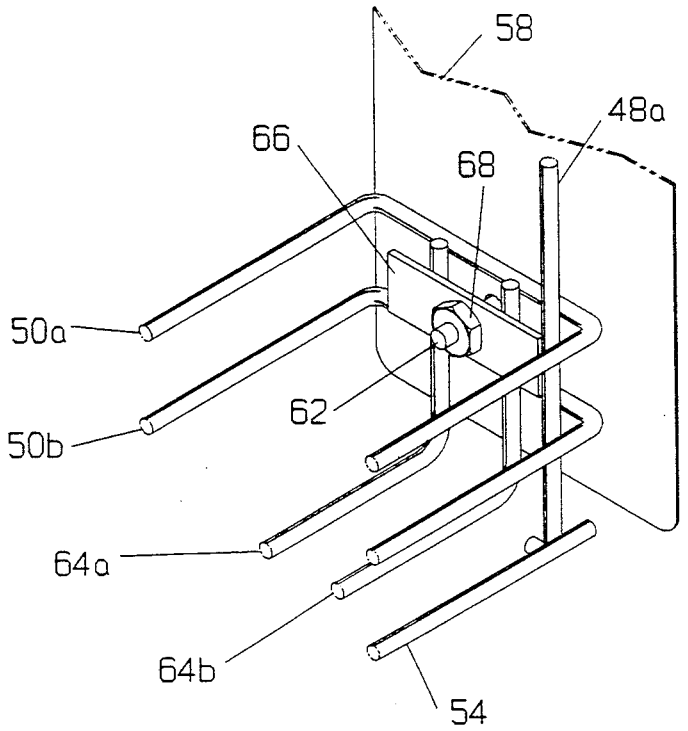
FIG. 3 is a fragmentary perspective view of a storage unit illustrating attachment of the front panel to the wire frame of the storage unit.

To assemble a storage system first one should slip U-shaped retainers 40 over stationary parts 28*a*, 28*b* of side mount slides 24 and 26 and then attach the stationary parts 28*a*, 28*b* to kitchen cabinet 16 inside the space vacated by a hood using screws 36 and 38 before a microwave oven is installed. Next microwave 14 should be installed following its own instructions. Then front panel 58 has to be attached to basket assembly 22 with bolts 62 and nuts 68 using back-up flat bars 66 as shown in FIG. 3.

Figure 4A:
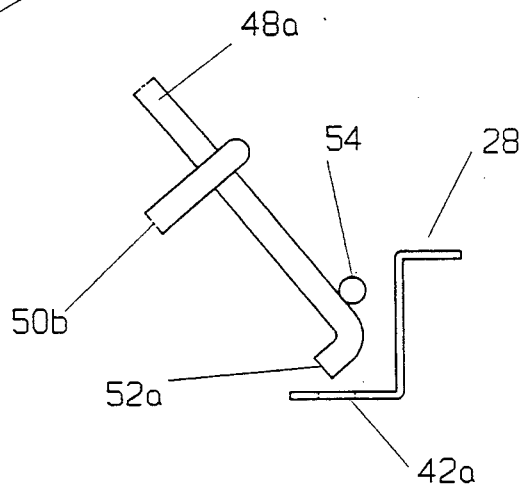
FIG. 4A - 4C are side views illustrating consecutive steps of installation of a storage unit into a side slide.
Figure 4C:
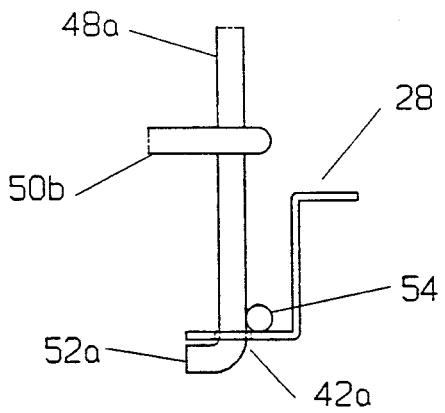
Figure 4B:
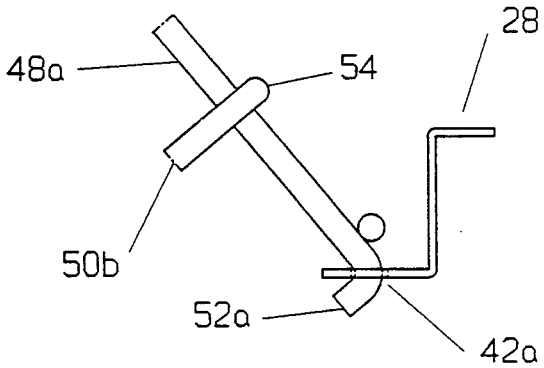

Consequent steps to engage whole basket assembly 22 and side mount slide 24 are shown in FIG. 4*a*–4*c*. First basket assembly 22 should be slightly tilted out as shown in FIG. 4*a* and bent ends 52*a*, 52*b* of vertical stands 48*a*, 48*b* have to be fitted through elongated slots 42*a*, 42*b* of moveable part 32*b* of side mount slide 24 as shown in FIG. 4*b*. Then basket assembly 22 has to be moved up into a vertical position as shown in FIG. 4*c*. Then identical moveable part 32*a* of side mount slide 26 with the same elongated slots has to be fitted over free upper ends 56*a*, 56*b* of vertical stands. Holding the whole assembly together and slightly tilting it up rollers 34 of moveable parts 32*a*, 32*b* should be fitted into corresponding stationary parts 28*a*, 28*b* of side mount slides 24 and 26 and then the whole assembly pushed inside.

Fit of front panel 58 between microwave oven 14 and kitchen cabinet 16 should be checked and if any correction is needed nuts 68 have to be loosen, front panel 58 should be readjusted and then nuts 68 tighten again.

To use storage unit 12 it should be pulled out of it closed position between microwave oven 14 and kitchen cabinet 16 by holding the whole assembly underneath front panel 58. At that time wheels 34 of moveable parts 32*a*, 32*b* of side mount slide assemblies 24 and 26 are rolling over surfaces 70*a*, 70*b* of stationary parts 28*a*, 28*b*. Moveable parts 32*a*, 32*b* are supported by rollers 30 of stationary parts 28*a*, 28*b* of the side mount slide assemblies. The whole storage assembly is stopped at the extreme extended position by stops built into side mount slides 24 and 26 to prevent the storage assembly from accidental disengagement from stationary parts 28*a*, 28*b*. After a desired item is taken out from the storage the whole assembly can be put back by simply pushing on front panel 58.

Thus the reader will see that I have provided a retractable storage system for a very confined narrow space adaptable to a great variety of different requirements with a high degree of utilization of that space. In one example a storage system was built to hold containers for spices in 2 spaces which were 3 inch wide and $15\frac{3}{4}$ inch high each. Each unit had 3 rows of baskets with each basket holding 4 typical containers $1\frac{7}{8}$ inch diameter and $4\frac{1}{4}$ inch high. Wire to build a basket assembly was $\frac{1}{8}$ inch diameter, 20 GA sheet metal strips were used for retainers to hold together side mount slides, a metal front panel was 18 GA thick, 16 GA back-up flat bars were $1\frac{7}{8}$ inch long, and #10–24 round head bolts with nuts were used to attach the front panel to the basket assembly. That storage system holds a total of 24 spice containers.

SUMMARY, RAMIFICATIONS, SCOPE

Thus it has been shown that the retractable storage system of the invention is simple in construction, inexpensive to manufacture, easy to install, easily adjustable for variations of measurements of an available space and matching colors, attractive in appearance, reliable in operation. It provides very good utilization of a narrow space.

The present invention has been shown and described in the form of specific embodiments of spice racks used in conjunction with an over-the-range microwave oven. It is understood, however, that this specific embodiment, its parts, materials and configurations were given only as examples, and that many other modifications of the spice rack of the invention are possible without departure from the spirit and scope of the invention. For example modifications of the spice rack of the invention are possible whenever the dimensions of new appliances and/or new cabinets do not exactly match the existing available spaces in a kitchen. Left and right sides of a storage system might not be positioned symmetrically. Microwave oven 14 may be positioned against one side of the kitchen cabinets with only one storage assembly been used on the other side. A number of baskets on an assembly may vary depending on height of the opening or specific items being stored. Upper ends 56*a* and 56*b* of vertical stands 48*a* and 48*b* may be bent out perpendicularly whereas lower ends 52*a* and 52*b* will stay straight. In this case straight wire piece 54 may connect vertical stands 48*a* and 48*b* either slightly lower under upper bends or above straight lower ends. Depth of the basket may vary again depending on intended usage. Other material may be used than those indicated, for example stainless steel or aluminum.

Therefore the scope of the invention should be determine, not by example given, but by the appended claims and their legal equivalents.

What I claim is:

1. A retractable storage system for a confined space between at least two stationary objects, comprising:

a frame with at least one storage member, said frame having an inner side and an outer side;

a guide means for guiding and supporting said frame in said confined space so that said frame can either be retracted to provide an access to said storage member, or moved into said confined space to a storage position;

said guide means being installed on a vertical wall of only one of said stationary objects and comprising at least one guide unit, said guide unit consisting of a stationary member which is rigidly attached to said only one stationary object and a moveable member for telescopically sliding in said stationary member, a means for holding said moveable member in an engaged position with said stationary member said moveable member having means for removably attaching said frame to said moveable member;

an external closing member attached to said outer side of said frame for closing said confined space when said frame is held in said storage position inside of said confined space;

2. The retractable storage system of claim 1 wherein said frame has a substantially rectangular configuration with portions projecting beyond the contours of said rectangular configuration and bent perpendicularly to the plane of said rectangular configuration, said frame having a length which corresponds to the depth of said confined space, said storage member being arranged in the direction of said depth and has a length which is shorter than said length of said frame.

3. The retractable storage system of claim 2 wherein said entire frame and said storage member are made of a metal wire, said storage member being shorter than said lengths of said frame by at least one fifth of said length of said frame.

4. The retractable storage system of claim 3 wherein said means for removably attaching said frame to said moveable member comprises holes in said moveable member, said wire having diameter smaller than diameters of said holes in order to provide free insertion of said bent projecting portions into said hole during assembly.

5. The retractable storage system of claim 4 wherein said frame further including locking means for locking said frame against falling under gravity with respect to said guide means.

6. The retractable storage system of claim 1 wherein the number of said storage members is three.

7. The retractable storage system of claim 1 wherein said means for holding said moveable member in said engaged position comprises a U-shaped yoke which can be put with a sliding fit over said stationary member and said moveable member so as to prevent their disengagement but allow their relative motion.

8. The retractable storage system of claim 1 wherein said confined space is a space between the inner sides walls of a standard-size kitchen cabinet and outer side walls of a standard-size microwave oven, the width of said microwave oven being shorter than the distance between said inner side walls.

9. The retractable storage system of claim 8 wherein said microwave oven is located above a cooking range, said confined space being divided into two portions arranged on both sides of said outer side walls.

10. The retractable storage system of claim 9 wherein said two portions are mirror images of each other.

11. A retractable storage system for a confined space between at least two stationary objects, comprising:

a frame with at least one storage member, said frame having an upper side, a lower side, an inner side and an outer side;

an upper guide means and a lower guide means for guiding and supporting said frame in said confined space so that said frame can either be retracted to provide an access to said storage member, or moved into said confined space to a storage position;

said upper guide means being arranged on said upper side of said frame, and said lower guide means being arranged on said lower side of said frame;

said upper guide means being installed on a vertical wall of one of said stationary objects and consists of an upper stationary member which is rigidly attached to said one stationary object and an upper moveable member for telescopically sliding in said upper stationary member, said upper moveable member having means for removably attaching said upper side of said frame to said upper moveable member;

said lower guide means being installed on the vertical wall of said same one stationary object and consists of an lower stationary member which is rigidly attached to said one stationary object and an lower moveable member for telescopically sliding in said lower stationary member, said lower moveable member having means for removably attaching said lower side of said frame to said lower moveable member;

a means for holding said upper moveable member and said lower moveable member in an engaged position with said upper stationary member and said lower stationary member, respectively;

an external closing member attached to said outer side of said frame for closing said confined space when said frame is held in said storage position inside of said confined space;

said frame having a substantially rectangular configuration with portions on said lower side projecting beyond the contours of said rectangular configuration and bent perpendicularly to the plane of said rectangular configuration, said frame having a length which corresponds to the depth of said confined space, said storage member being arranged in the direction of said depth and has a length which is shorter than said length of said frame.

12. The retractable storage system of claim 11 wherein said means for holding said upper moveable member in said engaged position comprises an upper U-shaped yoke which can be put with a sliding fit over said upper stationary member and said upper moveable member so as to prevent their disengagement but allow their relative motion, and said means for holding said lower moveable member in said engaged position comprises an lower U-shaped yoke which can be put with a sliding fit over said lower stationary member and said lower moveable member so as to prevent their disengagement but allow their relative motion.

13. The retractable storage system of claim 11 wherein said frame having said upper side projecting portions, said upper moveable member having upper holes, said projecting portions passing through said upper holes upward beyond said upper moveable member.

14. The retractable storage system of claim 13 wherein said entire frame and said storage member are made of a metal wire, said storage member being shorter than said lengths of said frame by at least one fifth of said length of said frame.

15. The retractable storage system of claim 14 wherein said frame further including locking means for locking said frame against falling under gravity with respect to said guide means.

16. The retractable storage system of claim 11 wherein the number of said storage members is three, said storage members being formed as baskets, said frame having vertical stands, said upper projecting portions being upper continuations of said vertical stands, said wires, which form said vertical stands of said frame being located inside of said baskets and being attached to said wires forming said baskets.

17. The retractable storage system of claim 16 wherein said external closing member has means for adjustably connecting said external closing member to said frame, said connecting means comprising at least one plate with a hole, said plate being located on the inside of at least one of said baskets, a bolt, and a nut, said bolt passing through said hole, said nut engaging said bolt.

18. The retractable storage system of claim 11 wherein said confined space is a space between the inner sides walls of a standard-size kitchen cabinets and outer side walls of a standard-size microwave oven, the width of said microwave oven being shorter than the distance between said inner side walls.

19. The retractable storage system of claim 18 wherein said microwave oven is located above a cooking range, said confined space being divided into two portions arranged on both sides of said outer side walls.

20. The retractable storage system of claim 9 wherein said two portions are a mirror images of each other.

* * * * *